US007914351B2

(12) United States Patent
Balsells et al.

(10) Patent No.: US 7,914,351 B2
(45) Date of Patent: Mar. 29, 2011

(54) ELECTRICAL CONNECTORS WITH IMPROVED ELECTRICAL CONTACT PERFORMANCE

(75) Inventors: Peter J. Balsells, Newport Coast, CA (US); Robbie J. Sjostedt, Foothill Ranch, CA (US); Farshid Dilmaghanian, Rancho Santa Margarita, CA (US)

(73) Assignee: Bal Seal Engineering, Foothill Ranch, CA (US)

( * ) Notice: Subject to any disclaimer, the term of this patent is extended or adjusted under 35 U.S.C. 154(b) by 411 days.

(21) Appl. No.: 12/102,626

(22) Filed: Apr. 14, 2008

(65) Prior Publication Data

US 2008/0254670 A1 Oct. 16, 2008

Related U.S. Application Data

(60) Provisional application No. 60/911,755, filed on Apr. 13, 2007.

(51) Int. Cl.
*H01R 13/33* (2006.01)

(52) U.S. Cl. ..... 439/840; 439/931

(58) Field of Classification Search ..... 439/349, 439/840, 841, 931
See application file for complete search history.

(56) References Cited

U.S. PATENT DOCUMENTS 4,072,154 A 2/1978 Anderson et al.
4,105,037 A 8/1978 Richter et al.
4,202,592 A 5/1980 Rullier et al.
4,262,673 A 4/1981 Kinney et al.
4,461,194 A 7/1984 Moore
4,655,462 A 4/1987 Balsells
4,678,210 A 7/1987 Balsells
4,826,144 A 5/1989 Balsells
4,876,781 A 10/1989 Balsells
4,907,788 A 3/1990 Balsells
4,929,188 A 5/1990 Lionetto et al.
4,934,366 A 6/1990 Truex et al.
5,134,244 A 7/1992 Balsells
5,288,242 A 2/1994 Muzslay
5,411,348 A 5/1995 Balsells
5,413,595 A 5/1995 Stutz, Jr.
5,545,842 A 8/1996 Balsells
5,599,027 A * 2/1997 Balsells ..... 277/642
5,615,870 A * 4/1997 Balsells ..... 267/167
5,704,809 A 1/1998 Davis
5,711,901 A 1/1998 Berg et al.
5,752,847 A 5/1998 McCormick
5,766,042 A 6/1998 Ries et al.
5,791,638 A 8/1998 Balsells
5,817,984 A 10/1998 Taylor et al.
5,866,851 A 2/1999 Taylor et al.
5,989,077 A * 11/1999 Mast et al. ..... 439/814
6,029,089 A 2/2000 Hawkins et al.
6,192,277 B1 2/2001 Lim et al.
6,428,368 B1 8/2002 Hawkins et al.
6,498,952 B2 12/2002 Imani et al.
6,607,393 B2 8/2003 Raypole et al.
6,671,554 B2 12/2003 Gibson et al.
6,749,358 B2 6/2004 Balsells
(Continued)

*Primary Examiner* — Ross N Gushi
(74) *Attorney, Agent, or Firm* — Klein, O'Neill & Singh, LLP

(57) ABSTRACT

Electrical connectors are generally discussed herein having a housing having a bore and a groove having a canted coil spring positioned therein. A pin is inserted through the bore and is electrically connected with the canted coil spring. The canted coil spring may be coated with a noble metal and the housing and the pin may be made from non-noble metals.

25 Claims, 4 Drawing Sheets

U.S. PATENT DOCUMENTS 6,835,084 B2 * 12/2004 Poon et al. ..... 439/349
6,869,301 B2 3/2005 Shimizu et al.
6,878,013 B1 4/2005 Behan
6,879,857 B2 4/2005 Swanson et al.
6,895,276 B2 5/2005 Kast et al.
7,003,351 B2 2/2006 Tvaska et al.
7,047,077 B2 5/2006 Hansen et al.
7,055,812 B2 6/2006 Balsells
7,062,329 B2 6/2006 Ostroff
7,063,563 B1 6/2006 Hsu
7,070,455 B2 7/2006 Balsells
7,083,474 B1 8/2006 Fleck et al.
7,108,549 B2 9/2006 Lyu et al.
7,110,827 B2 * 9/2006 Sage et al. ..... 607/116
7,120,027 B2 10/2006 Yatskov et al.
7,164,951 B2 1/2007 Ries et al.
7,187,974 B2 3/2007 Haeg et al.
7,195,523 B2 3/2007 Naviaux
7,210,398 B2 * 5/2007 Balsells ..... 92/194
7,241,180 B1 7/2007 Rentas Torres
7,263,401 B2 8/2007 Scott et al.
7,274,964 B2 * 9/2007 Balsells ..... 607/37
7,299,095 B1 11/2007 Barlow et al.
7,303,422 B2 12/2007 Hoffer et al.
7,316,593 B2 * 1/2008 Balsells ..... 439/827
7,326,083 B2 2/2008 Mehdizadeh et al.
7,429,199 B2 9/2008 Burgess
7,458,862 B2 * 12/2008 Zhao et al. ..... 439/840
2006/0146500 A1 7/2006 Yatskov
2006/0211276 A1 * 9/2006 Li ..... 439/66
2006/0224208 A1 10/2006 Naviaux
2007/0037456 A1 * 2/2007 Burgess ..... 439/841
2007/0042648 A1 * 2/2007 Balsells ..... 439/817
2007/0197099 A1 * 8/2007 DiStefano ..... 439/620.1
2007/0270041 A1 * 11/2007 Grube et al. ..... 439/662
2010/0029145 A1 * 2/2010 Balsells et al. ..... 439/827

* cited by examiner

| ITEM NO. | Bal Seal Canted Coil Spring Contact Series | Material Combinations for Bal Contact Springs (Wire Diameter 0.003 Inches) | Static Resistance (Average Value) (Ohms) |
|---|---|---|---|
| 1 | 101LC | MP35N-PVD Coated with 1$\mu$ Platinum Iridium | 0.0950 |
| 2 | 101LC | PT-IR (80% PL-20% IR Alloy) | 0.1008 |
| 3 | 101LC | MP-35N | 0.2000 |
| Number of contacts → | | | Five separate contacts tested |
| Number of tests → | | | One test per contact |

| ITEM NO. | Static Resistance Percent Variation Among Material | Dynamic Resistance (Average Value) (Ohms) | Dynamic Resistance Percent Variation Among Material | Frictional Running forces (in grams) |
|---|---|---|---|---|
| 1 | BASE | 0.1243 | BASE | 15 to 25 |
| 2 | 6% | 0.1254 | 1% | |
| 3 | 53% | 0.3803 | 67% | |
| Number of contacts → | | Five separate contacts tested | | |
| Number of tests → | | Five tests per contact | | |

FIG. 6

ELECTRICAL CONNECTORS WITH IMPROVED ELECTRICAL CONTACT PERFORMANCE

CROSS-REFERENCE TO RELATED APPLICATION

Priority is claimed to provisional application Ser. No. 60/911,755, filed on Apr. 13, 2007, entitled IMPLANTED MEDICAL ELECTRICAL CONNECTORS WITH IMPROVED ELECTRICAL CONTACT PERFORMANCE, the contents of which are hereby expressly incorporated herein by reference as if set forth in full.

The present invention is directed to medically implantable electrical connectors and more particularly to medical connectors having an improved configuration and improved reliability.

BACKGROUND

Electrical connectors are used in a number of medical devices, such as pacemakers, defibrillators, and neuro-stimulators. Medically implantable electrical connectors are inherently different from many other electrical connectors due to the environment and critical nature of their use. Such medical connectors must not only be made from biocompatible materials, but also should provide positive and unvarying conductivity in order to ensure reliability of a functioning medical device.

Noble metals have been found to provide desirable conductivity when placed between non-noble metal materials, such as stainless steel. However, noble metals exhibit a significantly lower ultimate tensile strength and are considerably more expensive than conventional implanted materials such as stainless steel or titanium. Accordingly, there is a need to produce an electrical connector which provides the desirable conductivity of noble metals combined with the desirable spring qualities of stainless steel and is relatively inexpensive to manufacture.

SUMMARY

Aspects of the present invention comprises an electrical connector with improved dynamic resistance. In one embodiment, the connector comprises: a housing having a bore and a groove having a canted coil spring positioned therein; and a pin inserted through the bore and in electrical communication with the canted coil spring; wherein the spring has an outer surface area made from a noble metal configured for contact with a non-noble metal surface area.

A further aspect of the present invention is a method for manufacturing an electrical connector. In one embodiment, the method comprises the steps of providing a housing having a bore and a groove for receiving a canted coil spring; coating a canted coil spring with a noble metal; inserting the canted coil spring into the groove; inserting a pin through the bore and the spring.

In yet another aspect of the present invention, a method for placing a noble metal between two non-noble metal surfaces of an electrical connector is provided. In one embodiment, the method comprises the steps of providing a housing having a groove having a surface made from a non-noble metal; placing a canted coil spring having an outer surface area made from a noble metal into the groove; and placing a pin having an outer surface area made from a non-noble metal in contact with the canted coil spring.

These and other features of the preferred electrical connector will become apparent when read in view of the drawings and detailed description as set forth herein.

BRIEF DESCRIPTION OF THE DRAWINGS

FIG. 6 is a table showing the results of static resistance and dynamic resistance testing of canted coil springs made from various materials.

DETAILED DESCRIPTION

The detailed description set forth below in connection with the appended drawings is intended as a description of the presently preferred embodiments of electrical connectors coated with noble metals. The electrical connectors provided in accordance with aspects of the present invention are not intended to represent the only forms in which the present invention may be constructed or used. The description sets forth the features and the steps for constructing and using aspects of the present invention in connection with the illustrated embodiments. It is to be understood that the same or equivalent functions and structures may be accomplished by different embodiments and are also intended to be encompassed within the spirit and scope of the present invention, especially those incorporating a combination of features shown in the different embodiments included herein. As denoted elsewhere herein, like element numbers are intended to indicate like or similar elements or features. Additionally, as used herein, "contact" means a discrete electrical path from a housing through a spring to a lead, electrode, or electrical contact and "connector" means an assembly of two or more contacts.

Figure 2:
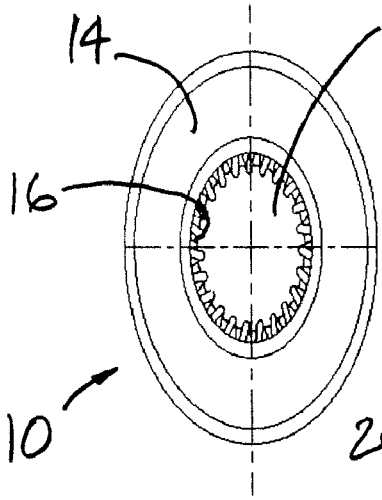
FIG. 2 is an end view of the housing of FIG. 1.
Figure 1:
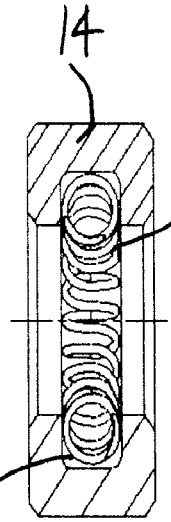
FIG. 1 is a cross-sectional side view of a housing containing a spring according to an exemplary embodiment of the present invention.
Figure 8:
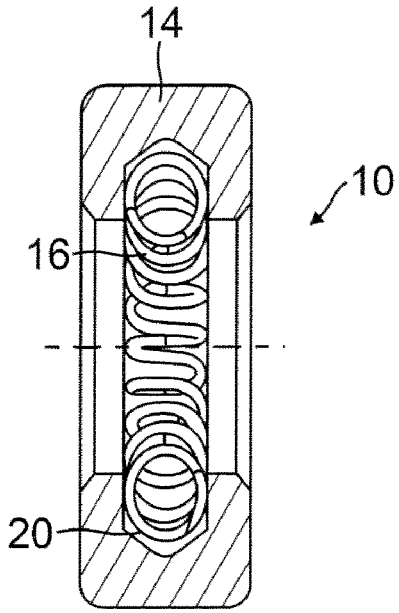
FIG. 8 is a cross-sectional side view of a housing containing a spring according to another embodiment of the present invention.

Referring now to FIGS. 1 and 2, an exemplary embodiment of a contact assembly 10 is shown. The contact assembly 10 includes a housing 14 having a centrally located bore 18 adapted to receive a lead pin 12 as described in more detail below. The housing 14 further includes a groove 20 recessed from an interior circumferential surface of the housing, the groove adapted to house a spring 16. As shown in FIG. 1, the groove 20 includes two sidewalls generally orthogonal to a longitudinal axis of the lead pin 12 and a back wall. The back wall is generally arc-shaped to match the arc of the housing 14. However, a V-groove back wall (FIG. 8) or a slanted back wall may be incorporated to change the orientation of the spring. In other embodiments, the housing is made from two or more assembled housing parts, such as an L-shape cross-section housing attached to a plate to form a housing with a groove. In one exemplary embodiment, the housing 14 is made from a non-noble metal. For example, the housing 14 may be made from high-strength nickel alloy, such as MP35N®, or stainless steel, such as 316L stainless steel.

Figure 3:
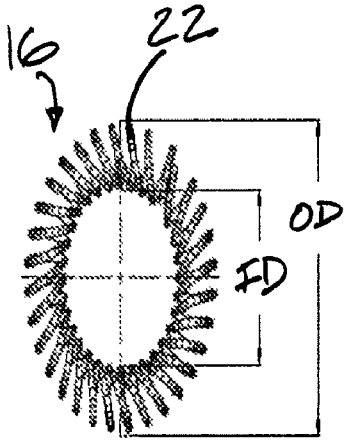
FIG. 3 is an end view of an exemplary canted coil spring according to aspects of the present invention.
Figure 4:
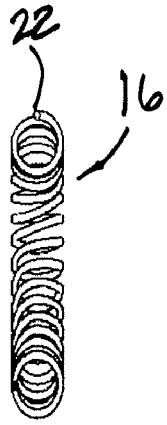
FIG. 4 is a cross-sectional side view of the canted coil spring of FIG. 3 taken along a vertical centerline of the spring coil.

With reference also to FIGS. 3 and 4, in one exemplary embodiment, the spring 16 is a canted coil spring and, more specifically, may be a radial or axial canted coil spring. Radial and axial canted springs are well known in the industry and are commercially available from Bal Seal Engineering of Foothill Ranch, Calif. The spring 16 includes a plurality of coils 22, each coil having a coil height and a coil width. The plurality of coils are canted along a same direction relative to a plane normal to the spring. In one exemplary embodiment, the spring is made from a non-noble metal, for example, high-strength nickel alloy, such as MP35N®, or stainless steel, such as 316L stainless steel. To couple the spring 16 to the housing 14, the spring is compressed to be insertable into the bore 18 and then allowed to expand into the groove 20 within the housing 14 such that it is constrained by the groove as shown in FIG. 2. In one exemplary embodiment, an inner diameter of an unstressed spring 16 is smaller than an inner diameter of the bore 18 such that when the spring is housed within the groove 20, a portion of each coil 22 protrudes into the bore 18. Accordingly, when a lead pin 12 having a diameter slightly smaller than an inner diameter of the bore 18 is inserted into the bore as described in more detail below, the coils 22 will make contact with the lead pin. Additionally, an outer diameter of an unstressed spring 16 may be slightly larger than the diameter of the groove 20 such that when the spring is located in the groove, the spring exerts a radial force on the back wall of the groove. In one embodiment, the lead pin 12 incorporates a tapered axial end to facilitate insertion into the bore 18. In another embodiment, the lead pin 12 incorporates a groove for seating the spring when inserted into the bore.

Figure 4A:
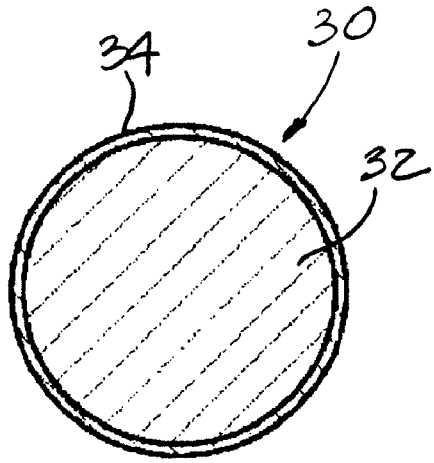
FIG. 4A is a cross-sectional end view of a wire used to form the canted coil spring of FIGS. 3 and 4.

In one exemplary embodiment, the spring 16 is coated with a noble metal, and more specifically, a noble metal that is substantially non-oxidizing in the presence of body fluids. FIG. 4A is a cross-sectional end view of a wire 30 used to form the spring 16 of FIGS. 3 and 4. In one embodiment, the wire 30 has an inner-core 32 of a non-noble metal and an outer layer 34 having an outer surface made of a noble metal. In another embodiment, a third layer of a 2nd noble metal is incorporated. As is described in more detail below, it has been found that noble metals provide corrosion resistance and low and more consistent electrical contact resistance when they contact other non-noble metals versus non-noble metal to non-noble metal contact.

Figure 5:
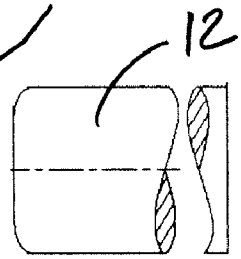
FIG. 5 is a side view of a pin according to an exemplary embodiment of the present invention.

To complete the contact, a lead pin 12, as shown in FIG. 5, may be inserted through the bore 18 of the housing 14. In one exemplary embodiment, the lead pin 12 is generally cylindrical and has a diameter that is slightly smaller than an inner diameter of the bore 18 but is larger than the inner diameter of the spring so as to compress the spring when inserted into the bore. Thus, when the lead pin 12 is inserted through the bore 18, the lead pin contacts the coils 22 of the spring 16 to establish an electrical connection between the lead pin, the spring, and the housing 14. Preferably, the lead pin 12 compresses the spring to a range of about 5% to about 60% of the total radial compression of the spring and more preferably in the range of about 15% to about 45% of the total radial compression of the spring to provide sufficient spring contact force.

It has been found that when noble metals are coated onto other non-noble metal coil springs, the noble metal coating on non-noble metals produces similar results with respect to static and dynamic resistance as when a coil spring is made entirely from noble metal. As measured herein, static resistance is a measurement of the contact resistance with no motion of the lead, while dynamic resistance is a measurement of the contact resistance when the lead is in motion due to body movement.

FIG. 6 shows the results of tests measuring the static and dynamic electrical contact resistance created through contacts having different configurations and properties. The static and dynamic resistance was measured using a Bal Seal canted coil spring made from (1) MP-35N® coated with 1 micron platinum, (2) entirely from platinum-iridium alloy and (3) entirely from MP-35N® nickel metal alloy. As shown in FIG. 6, using the MP-35N® coated with 1 micron platinum spring as the base value, the platinum-iridium alloy spring exhibited about 6% greater static resistance and about 1% greater dynamic resistance, while the MP-35N® spring exhibited about 53% greater static resistance and about 67% greater dynamic resistance. Accordingly, the high nickel steel MP-35N® coated with platinum-iridium spring performed significantly similarly to the spring made entirely from platinum-iridium alloy. Thus, a connector utilizing a spring made from a non-noble metal coated with a noble metal can be made much more cost effective than one made of 100% solid platinum, solid 80%-20% platinum-iridium alloy, or other solid noble metal.

By coating a non-noble metal element with a noble metal, the more desirable conductive and corrosion resistant properties of the noble metal are married with the more desirable spring properties and significantly lower cost of non-noble metals such as high-strength nickel alloys and stainless steel. Desirable spring properties include stiffness and increased spring rate. Examples of materials that may be used for coating include platinum, iridium, rhodium, rhenium, ruthenium, palladium, or alloys of two or more of such materials used in various percentages. Also, it is noteworthy that the coated spring can use pure platinum whereas the platinum only spring must have a small percentage of iridium alloyed with the platinum in order to achieve the desired spring properties. In one exemplary embodiment, the coating may be applied by a vapor disposition process, which is generally known in the coating industry. In applications where a soft coating is desired, 100% platinum may be used. In cases where a harder material is desired, for example in wear-resistant applications, a binary composition of platinum and iridium may be used. Generally, the larger percentage of iridium used, the harder is the coating. In one exemplary embodiment, the coating has a thickness of at least about 1 micron. The larger percentage of platinum used, the lower the contact resistance.

Figure 7:
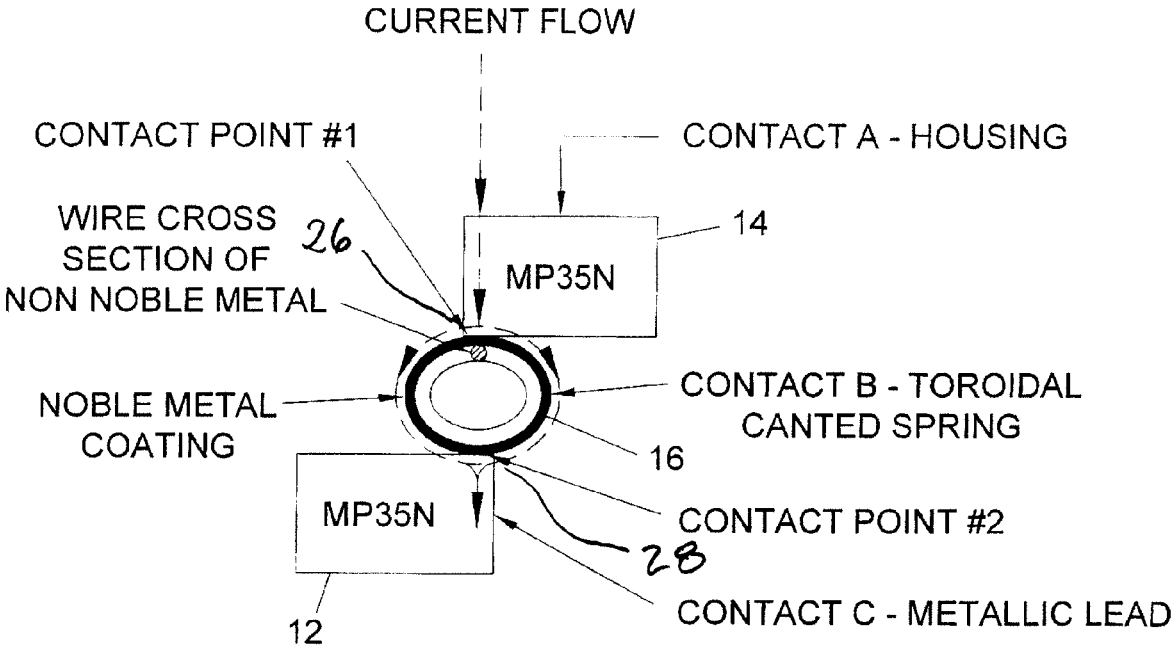
FIG. 7 is a schematic view of an exemplary contact according to the present invention.

As shown schematically in FIG. 7, the contact assembly 10 includes three contact elements, which are the housing 14, the spring 16, and the lead pin 12. Together, the three contact elements have at least two contact points, which include a first contact point 26 between the housing and the spring, and a second contact point 28 between the spring and the lead pin. Positioning a contact element including a noble metal or a noble metal alloy between two non-noble metals has been found to eliminate or reduce oxidation or other adverse corrosion at the first and second contact points 26, 28 by a materially significant amount. Accordingly, because of the substantial lack of measurable oxidation, there is a substantial lack of resistivity change through these points. As noted above, it has been found that the lack of resistivity change between the contact points 26, 28 is substantially equal whether the noble metal contact element (i.e., the spring 16) is made entirely from a noble metal or whether the noble metal contact element is merely coated with a noble metal.

As can be appreciated, aspects of the present invention include a method for maintaining static and/or dynamic resistance in an electrical connector to within 20% or less, preferably to 10% or less, and still more preferably to within 6% or less, using a spring having a wire made from at least one non-noble metal core and at least one outer layer of a noble metal compared to a spring having a wire made entirely from a noble metal. A still further aspect of the present invention is a method for maintaining static and/or dynamic resistance in an electrical connector to perform 30% or better, preferably 40% or better, and still more preferably 50% or better, using a spring having a wire made from at least one non-noble metal core and at least one outer layer of a noble metal compared to a spring having a wire made entirely from anon-noble metal.

The spring 16 described elsewhere herein may be used with the connector assemblies shown and described in U.S. patent application Ser. No. 60/911,161, filed Apr. 11, 2007, entitled INTEGRATED HEADER CONNECTOR SYSTEM, Ser. No. 60/910,765, filed Apr. 9, 2007, entitled CONNECTOR ASSEMBLY FOR USE WITH MEDICAL DEVICES, Ser. No. 12/062,895, filed Apr. 4, 2007, entitled CONNECTOR ASSEMBLY FOR USE WITH MEDICAL DEVICES, and to Ser. No. 61/044,408, entitled ENCAPSULATED CONNECTOR STACK. The contents of the foregoing provisional/ordinary applications are expressly incorporated herein by reference as if set forth in full.

Figure 9:
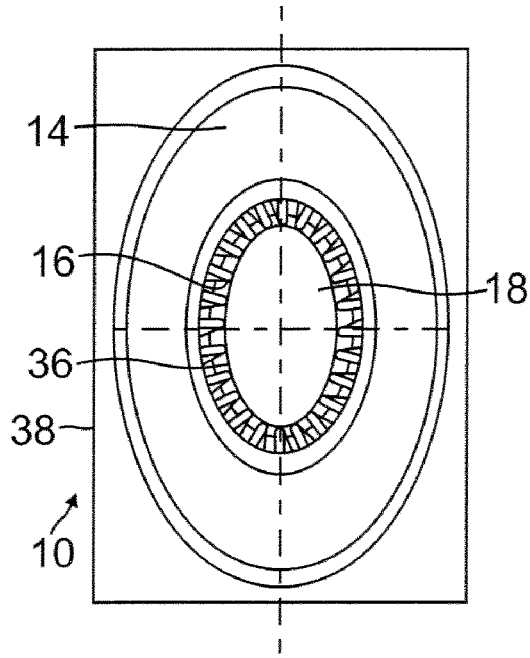
FIG. 9 is an end view of a housing containing a spring according to another embodiment of the present invention.
Figure 10:
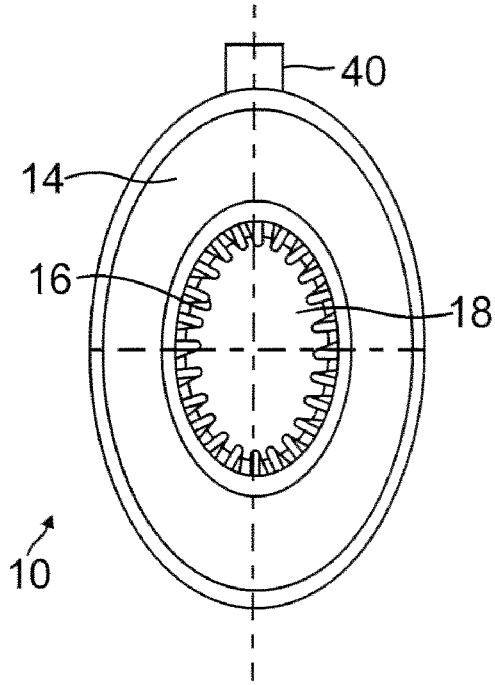
FIG. 10 is an end view of a housing containing a spring according to another embodiment of the present invention.

Although limited exemplary embodiments and methods for making and using electrical connectors provided in accordance with aspects of the present invention have been specifically described and illustrated, many modifications and variations will be apparent to those skilled in the art. For example, various materials may be used and the coating may be applied by various coating methods and the electrical connector can be used in non-implant applications, such as for a car battery terminal. Additionally, various types of springs and housings may be used and the springs and housings may have a wide variety of configurations. For example, the pin can be part of a terminal 36 of a battery 38, and the housing attached to a lead conductor 40 for carrying electrical current to another device, as shown in FIGS. 9 and 10. Accordingly, it is to be understood that the electrical connectors constructed according to principle of this invention may be embodied other than as specifically described herein. The invention is also defined in the following claims.

What is claimed is:

1. An electrical connector with improved dynamic resistance comprising:

a housing having a bore and a groove having a canted coil spring positioned therein; and a pin inserted through the bore and in electrical communication with the canted coil spring;

wherein the spring has an inner core and an outer layer having different material compositions, with the outer layer comprising at least one of platinum, iridium, rhodium, rhenium, ruthenium and palladium, the outer layer having sufficient thickness to provide the spring with an electrical resistance that is within 20% or less of a spring made entirely of at least one of platinum, iridium, rhodium, rhenium, ruthenium and palladium.

2. The electrical connector of claim 1, wherein the pin or the groove of the housing comprises a surface area of a material that does not include platinum, iridium, rhodium, rhenium, ruthenium or palladium.

3. The electrical connector of claim 1, wherein the inner core comprises a material that does not include platinum, iridium, rhodium, rheniun ruthenium or al1adium.

4. The electrical connector of claim 3, wherein the inner core is made from a nickel alloy or a stainless steel material.

5. The electrical connector of claim 1, wherein the spring is a radial canted coil spring.

6. The electrical connector of claim 1, wherein the outer layer provides the spring with an electrical resistance that is within 10% or less of a spring made entirely of at least one of platinum, iridium, rhodium, rhenium, ruthenium and palladium.

7. The electrical connector of claim 6, wherein the outer layer provides the spring with an electrical resistance that is within 6% or less of a spring made entirely of at least one of platinum, iridium, rhodium, rhenium, ruthenium and palladium.

8. A method for manufacturing an electrical connector comprising:

providing a housing having a bore and a groove for receiving a canted coil spring;

coating an inner core of a canted coil spring with an outer layer comprising at least one of platinum, iridium, rhodium, rhenium, ruthenium and palladium, the inner core comprising a material that does not include platinum, iridium, rhodium, rhenium, ruthenium or palladium;

inserting the canted coil spring into the groove; and inserting a pin through the bore and the spring;

wherein the outer layer has a thickness sufficient to provide the spring with an electrical resistance that is at least 30% less than an electrical resistance of a spring that is made from one or more materials not including any of platinum, iridium, rhodium, rhenium, ruthenium and palladium.

9. The method of claim 8, wherein the outer layer is coated over an inner core comprising a material that does not include platinum, iridium, rhodium, rhenium, ruthenium or palladium.

10. The method of claim 9, wherein the inner core is a nickel alloy metal or a stainless steel material.

11. The method of claim 9, wherein the inner core is nickel alloy or stainless steel.

12. The method of claim 8, wherein the housing is made from a material that does not include platinum, iridium, rhodium, rhenium, ruthenium or palladium.

13. The method of claim 8, wherein the housing is made from at least two different housing sections.

14. The method of claim 8, wherein the pin comprises a groove.

15. The method of claim 8, wherein the outer layer has a thickness sufficient to provide the spring with an electrical resistance that is at least 40% less than an electrical resistance of a spring that is made from one or more materials not including any of platinum, iridium, rhodium, rhenium, ruthenium and palladium.

16. The method of claim 15, wherein the outer layer has a thickness sufficient to provide the spring with an electrical resistance that is at least 50% less than an electrical resistance of a spring that is made from one or more materials not including any of platinum, iridium, rhodium, rhenium, ruthenium and palladium.

17. A method for placing at least one of platinum, iridium, rhodium, rhenium, ruthenium or palladium between two surfaces of an electrical connector, the two surfaces comprising materials that do not include platinum, iridium, rhodium, rhenium, ruthenium or palladium, the method comprising:

providing a housing having a groove having a surface made from a material that does not include platinum, iridium, rhodium, rhenium, ruthenium or palladium;

placing a canted coil spring having an inner core comprising a material that does not include platinum, iridium, rhodium, rhenium, ruthenium or palladium and an outer surface area made from at least one of platinum, iridium, rhodium, rhenium, ruthenium and palladium into the groove, the outer surface area providing the canted coil spring with an electrical resistance that is within 20% or less of a sprine made entirely of at least one of platinum, iridium, rhodium, rhenium, ruthenium and palladium, and is at least 30% less than an electrical resistance of a spring that is made from one or more materials not including any of platinum, iridium, rhodium, rhenium, ruthenium and palladium; and placing a pin having an outer surface area made from a material that does not include platinum, iridium, rhodium, rhenium, ruthenium or palladium in contact with the canted coil spring.

18. The method of claim 17, wherein the spring outer surface area is coated over an inner core comprising a material that does not include platinum, iridium, rhodium, rhenium, ruthenium or palladium.

19. The method of claim 18, wherein the inner core is nickel alloy or stainless steel.

20. The method of claim 17, wherein the housing comprises two side walls, at least one of which made from a separately formed housing section.

21. The method of claim 17, wherein the pin is part of a battery terminal.

22. The method of claim 17, wherein the housing comprises an exterior surface attached to a lead conductor.

23. The method of claim 17, wherein the groove comprises a generally V-shape wall surface.

24. The method of claim 17, wherein the outer surface area provides the canted coil spring with an electrical resistance that is within 10% or less of a spring made entirely of at least one of platinum, iridium, rhodium, rhenium, ruthenium and palladium, and is at least 40% less than an electrical resistance of a spring that is made from one or more materials not including any of platinum, iridium, rhodium, rhenium, ruthenium and palladium.

25. The method of claim 24, wherein the outer surface area provides the canted coil spring with an electrical resistance that is within 6% or less of a spring made entirely of at least one of platinum, iridium, rhodium, rhenium, ruthenium and palladium, and is at least 50% less than an electrical resistance of a spring that is made from one or more materials not including any of platinum, iridium, rhodium, rhenium, ruthenium and palladium.

* * * * *

UNITED STATES PATENT AND TRADEMARK OFFICE

CERTIFICATE OF CORRECTION

PATENT NO. : 7,914,351 B2
APPLICATION NO. : 12/102626
DATED : March 29, 2011
INVENTOR(S) : Peter J. Balsells et al.

It is certified that error appears in the above-identified patent and that said Letters Patent is hereby corrected as shown below:

In column 5, line 17, delete “anon-noble” and insert -- a non-noble --, therefor.

In column 6, line 3, in Claim 3, delete “rheniun” and insert -- rhenium, --, therefor.

In column 6, line 3, in Claim 3, delete “al1adium.” and insert -- palladium. --, therefor.

In column 7, line 11, in Claim 17, delete “sprine” and insert -- spring --, therefor.

Signed and Sealed this
Sixth Day of September, 2011

David J. Kappos

David J. Kappos
*Director of the United States Patent and Trademark Office*